US011417182B2

(12) United States Patent
Shamai

(10) Patent No.: US 11,417,182 B2
(45) Date of Patent: Aug. 16, 2022

(54) CONTACT SENSOR WITH MASKING DETECTION FEATURE

(71) Applicant: TYCO FIRE & SECURITY GMBH, Neuhausen am Rheinfall (CH)

(72) Inventor: Yossi Shamai, Herzliya (IL)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 17/281,917

(22) PCT Filed: Nov. 13, 2019

(86) PCT No.: PCT/EP2019/081246
§ 371 (c)(1),
(2) Date: Mar. 31, 2021

(87) PCT Pub. No.: WO2020/099521
PCT Pub. Date: May 22, 2020

(65) Prior Publication Data

US 2021/0383663 A1 Dec. 9, 2021

Related U.S. Application Data

(60) Provisional application No. 62/760,803, filed on Nov. 13, 2018.

(51) Int. Cl.
*G08B 13/08* (2006.01)
*G08B 29/04* (2006.01)
*G08B 29/20* (2006.01)

(52) U.S. Cl.
CPC ..... *G08B 13/08* (2013.01); *G08B 29/046* (2013.01); *G08B 29/20* (2013.01)

(58) Field of Classification Search
CPC ..... G08B 13/08; G08B 29/046; G08B 29/20
See application file for complete search history.

(56) References Cited

U.S. PATENT DOCUMENTS 6,121,864 A * 9/2000 Tillmann ..... G08B 13/08 200/61.14
7,280,017 B2 * 10/2007 Yuze ..... H01H 36/0046 335/151
9,324,222 B2 * 4/2016 Buckley ..... G08B 29/046
9,767,660 B1 * 9/2017 Skarda ..... G08B 13/08
10,565,842 B2 * 2/2020 Zhevelev ..... H04N 7/18
(Continued)

FOREIGN PATENT DOCUMENTS

WO 2017117402 A2 7/2017

OTHER PUBLICATIONS

International Search Report and Written Opinion issued in corresponding International Application No. PCT/EP2019/081246 dated Feb. 19, 2020.

*Primary Examiner* — John A Tweel, Jr.
(74) *Attorney, Agent, or Firm* — ArentFox Schiff LLP

(57) ABSTRACT

A contact sensor includes a permanent magnet, first and second magnetic field sensors, and a computing device in communication with the first and second magnetic field sensors and configured to execute an "Open/Close" function to generate an "Open/Close" decision, and a "Masking" function to generate a "Masking" decision, based on at least one of a first measurement from the first magnetic field sensor or a second measurement from the second magnetic field sensor.

19 Claims, 4 Drawing Sheets

(56) References Cited

U.S. PATENT DOCUMENTS

| | | | | |
|---|---|---|---|---|
| 2010/0289630 | A1 | 11/2010 | Suzuki et al. | |
| 2014/0062466 | A1* | 3/2014 | Thibault | G01B 7/14 324/207.22 |

* cited by examiner

CONTACT SENSOR WITH MASKING DETECTION FEATURE

CROSS-REFERENCE TO RELATED APPLICATIONS

This application is a 35 U.S.C. § 371 National Phase Application of PCT Application No. PCT/EP2019/081246 filed Nov. 13, 2019, entitled "CONTACT SENSOR WITH MASKING DETECTION FEATURE," which claims benefit to U.S. Provisional Application Ser. No. 62/760,803 filed Nov. 13, 2018, entitled "CONTACT SENSOR WITH MASKING DETECTION FEATURE." The disclosure of each one of these prior applications are hereby incorporated by reference herein in their entirety.

BACKGROUND

The present disclosure relates generally to security devices, and more specifically, to a contact sensor.

Generally, a contact sensor, such as a "Door/Window Contact," may detect an "Open/Close" event or status of a door or window. For example, a contact sensor may use a reed switch placed adjacent to a permanent magnet such that the "ON/OFF" status of the reed switch changes with a relative movement of the permanent magnet with respect to the reed switch. However, an intruder may attempt to tamper with the contact sensor by placing a second permanent magnet adjacent to the reed switch to change or alter the total magnetic field that affects the operation of the reed switch such that the relative movement of the original permanent magnet no longer affects the "ON/OFF" status of the reed switch.

Some known contact sensors detect such tampering attempts by adding additional reed switches close to the main reed switch. As such, one of the additional reed switches changes status if an intruder introduces an additional tampering magnet. However, these known contact sensors are unreliable, costly, and take up a lot more space.

Accordingly, more reliable and cost-effective contact sensors are needed.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

Aspects of the present disclosure provide a contact sensor that uses two magnetic field sensors, such as Hall effect sensors, that are placed adjacent to a permanent magnet to: (1) detect an "Open/Close" event or status of a door or window, and (2) determine whether the contact sensor has been tampered with by adding a masking magnetic field.

In an implementation, for example, the present disclosure includes a contact sensor comprising a first magnetic field sensor configured to make a first measurement of a magnetic field, and a second magnetic field sensor configured to make a second measurement of the magnetic field. The contact sensor further includes a computing device in communication with the first magnetic field sensor and the second magnetic field sensor and configured to execute an "Open/Close" function and a "Masking" function based on at least one of the first measurement or the second measurement.

To the accomplishment of the foregoing and related ends, the one or more aspects comprise the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components may be shown in block diagram form in order to avoid obscuring such concepts.

Aspects of the present disclosure provide a reliable contact sensor that includes two magnetic field sensors, such as Hall effect sensors, that make two respective measurements of a magnetic field induced by a permanent magnet. The contact sensor uses the measurements of the magnetic field sensors to detect an "Open/Close" status of a door/window and also to detect a masking status, e.g., to recognize if a tampering or masking permanent magnet is introduced to tamper with the contact sensor. In an aspect, for example, the contact sensor may be a "Door/Window Contact."

In an implementation, the two magnetic field sensors have a fixed position relative to one another, and have a sensing direction that is parallel to a direction of the magnetic field of the permanent magnet. Further, to enhance the masking detection capabilities by enabling easier detection of masking attempts, the contact sensors may be calibrated such that the two magnetic field sensors have their highest magnetic field measurements in response to the permanent magnet being in a closed position of the window or door.

The presently disclosed aspects may be applicable to any system that indicates a status of two components that move relative to one another, such as a security system that indicates an open/close status of entrance doors/windows, a home automation system that indicates an open/close status of entrance doors/windows and/or home appliance doors/windows, etc.

Turning now to the figures, example aspects are depicted with reference to one or more components described herein, where components in dashed lines may be optional.

Figure 1:
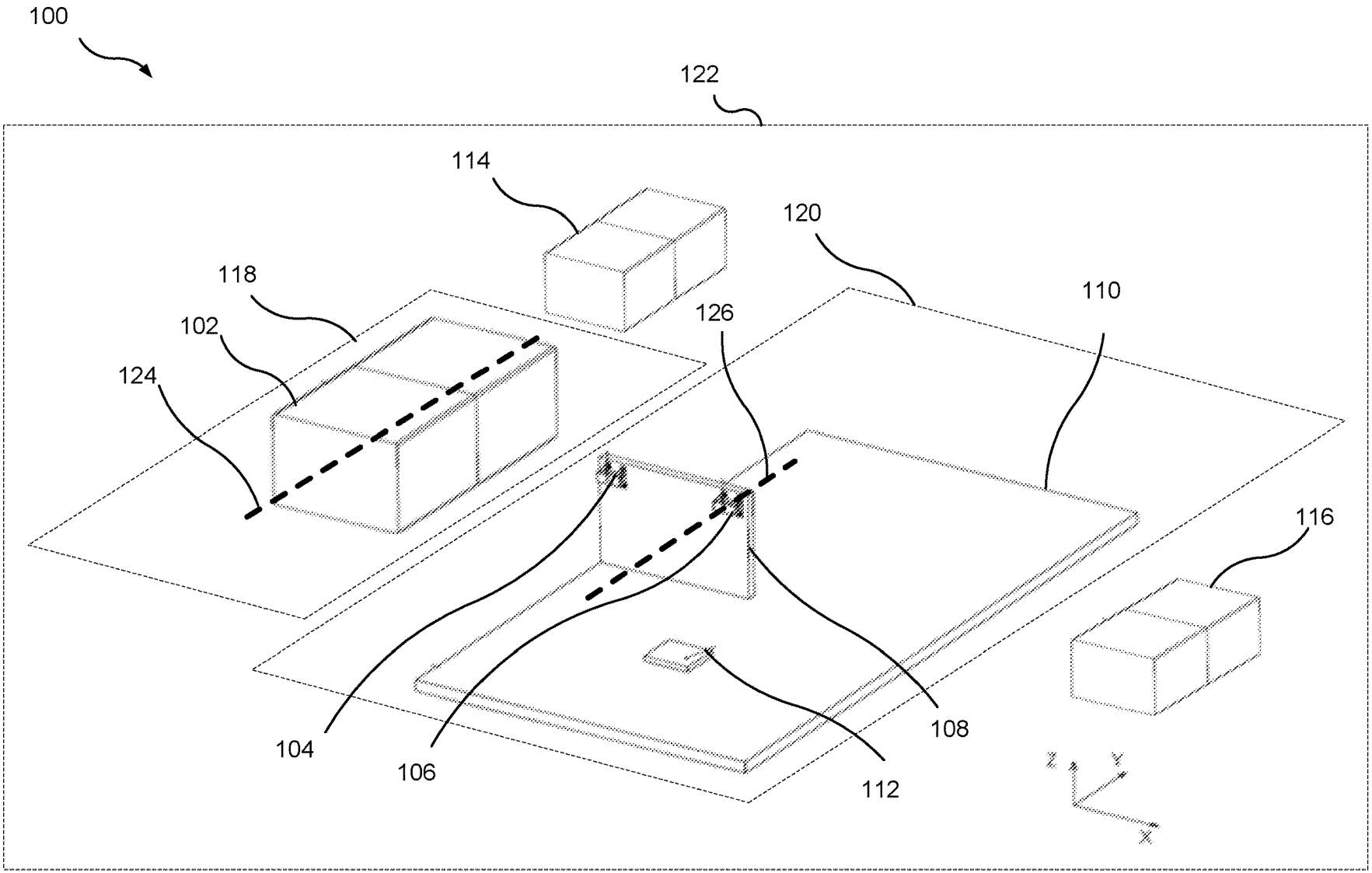
FIG. 1 is a top perspective view of an example contact sensor.

Referring to FIG. 1, one example of a contact sensor 100 includes a first magnetic field sensor 104 and a second magnetic field sensor 106 configured to make respective measurements of an adjacent magnetic field, wherein at least one of the magnetic field measurements is used to make an "Open/Close" decision regarding a corresponding door/window 122, and at least one or both of the magnetic field measurements are used to make a "Masking" decision regarding an attempt to tamper with the contact sensor 100. The first magnetic field sensor 104 and the second magnetic field sensor 106 may be, for example, Hall effect sensors, microelectromechanical systems (MEMS)—based magnetic field sensors, or any other type of magnetometer. The contact sensor 100 may further include a permanent magnet 102 attachable to a first door/window component 118 of the door/window 122, wherein the first magnetic field sensor 104 and the second magnetic field sensor 106 are positionable adjacent to and opposing the permanent magnet 102 on a second door/window component 120 of the door/window 122. In an implementation, the first magnetic field sensor 104 and the second magnetic field sensor 106 have a fixed position relative to one another, and have a sensing direction 126 that is substantially parallel to a magnetic field axis 124 of the permanent magnet 102. Further, the contact sensor 100 may be calibrated such that the first magnetic field sensor 104 and the second magnetic field sensor 106 have their highest magnetic field measurements in response to the permanent magnet 102 being in a closed position of the door/window 122.

In an aspect, the first door/window component 118 may be a movable component of the door/window 122, and the second door/window component 120 may be a door/window frame movably holding the first door/window component 118. However, in an alternative aspect, the second door/window component 120 may be a movable component of the door/window 122, and the first door/window component 118 may be a door/window frame movably holding the second door/window component 120. In an aspect, for example, the first door/window component 118 may be hinge-ably attached to the second door/window component 120 and therefore may be movable with respect to the second door/window component 120 in a rotational direction along the hinge. Alternatively, the first door/window component 118 may be slide-ably attached to the second door/window component 120 and therefore may be movable with respect to the second door/window component 120 in a sliding direction in parallel to a plane where the first door/window component 118 and the second door/window component 120 extend.

It should be noted that the aforementioned are only some non-limiting example aspects, and the first door/window component 118 may be movable with respect to the second door/window component 120 in other ways. In some non-limiting aspects, for example, the door/window 122 may be a door that opens by a movement in a Z axis direction, may be a roller door that moves up/down in a Y axis direction, or may be a sliding door/window that opens in an X axis direction.

In either alternative aspect, a relative movement of the first door/window component 118 with respect to the second door/window component 120 may cause a relative movement of the permanent magnet 102 with respect to the first magnetic field sensor 104 and the second magnetic field sensor 106. This relative movement causes a change in the magnetic field measurements made by the first magnetic field sensor 104 and the second magnetic field sensor 106. For example, the permanent magnet 102 may move between a closed position and an open position relative to the first magnetic field sensor 104 and the second magnetic field sensor 106. For instance, the closed position may be one of a plurality positions of the permanent magnet 102 that is closest to the first magnetic field sensor 104 and the second magnetic field sensor 106. Similarly, the open position may be one of the plurality positions of the permanent magnet 102 that is different from the open position. Accordingly, the contact sensor 100 may detect an "Open/Close" status of the door/window 122 based on the magnetic field measurements made by at least one of the first magnetic field sensor 104 and the second magnetic field sensor 106.

For example, in an aspect, the contact sensor 100 may detect an "Open" status of the door/window 122 when the magnetic field measurements made by the first magnetic field sensor 104 is below an "Open" magnetic field threshold, and may detect a "Close" status of the door/window 122 when the magnetic field measurements made by the first magnetic field sensor 104 is above a "Close" magnetic field threshold. In an aspect, the "Open" magnetic field threshold may be substantially the same as the "Close" magnetic field threshold. In an alternative aspect, the "Open" magnetic field threshold may be smaller than the "Close" magnetic field threshold to allow for an "Open/Close" measurement tolerance.

In an aspect, for example, the "Open" magnetic field threshold and the "Close" magnetic field threshold may be fixed and pre-defined values that are pre-programmed (e.g., as hard-coded software) in the contact sensor 100 and indicate magnetic field strength values corresponding to "Open" and "Close" positions of the door/window 122. In an aspect, the "Open" magnetic field threshold and the "Close" magnetic field threshold may be obtained as a result of research and development tests and/or may be set to meet standards requirements (e.g., Underwriters Laboratories (UL) requirements). In these aspects, the "Open/Close" decision may be decided when a magnetic field measurement is below/above a corresponding pre-defined threshold value. In an aspect, during installation, an installer positions the permanent magnet 102 on the first door/window component 118 and positions the first magnetic field sensor 104 and the second magnetic field sensor 106 opposing the permanent magnet 102 on the second door/window component 120, such that the contact sensor 100 correctly indicates an "Open/Close" status of the door/window 122 based on the fixed, pre-defined, and pre-programmed "Open" and "Close" magnetic field thresholds that meet standards requirements. In addition, the installer may perform the positioning of the permanent magnet 102, the first magnetic field sensor 104, and the second magnetic field sensor 106 relative to one another to assure proper "Masking" detection. For example, as described below with reference to some non-limiting aspects that include the sensor board 108, the installer may install the permanent magnet 102 and the sensor board 108 such that when the door/window 122 is closed the sensor board 108 is aligned with the center of the permanent magnet 102 and is equidistant from a North pole end and a South pole end of the permanent magnet 102. Subsequently, in a second phase of the installation process and while the door/window 122 is closed, the contact sensor 100 may execute a calibration process to "learn" and calibrate the thresholds for making "Masking" decisions. Further details of the calibration process are described below with reference to FIG. 3.

In some alternative aspects, however, the "Open" magnetic field threshold and the "Close" magnetic field threshold may not be pre-defined and may instead be set during a calibration process after the permanent magnet 102 is positioned on the first door/window component 118 of the door/window 122 and the first magnetic field sensor 104 and the second magnetic field sensor 106 are positioned opposing the permanent magnet 102 on the second door/window component 120 of the door/window 122. For example, the calibration process may include obtaining at least a first calibration magnetic field measurement made by the first magnetic field sensor 104 (and/or the second magnetic field sensor 106) with the permanent magnet 102 mounted to the first door/window component 118 and in a "closed" position, and, optionally, a second calibration magnetic field measurement made by the first magnetic field sensor 104 (and/or the second magnetic field sensor 106) with the permanent magnet 102 mounted to the first door/window component 118 and in an "open" position. In some aspects, the "Masking" decision may similarly be based on corresponding "Masking" threshold values that are set during installation in the calibration process. Further details of the calibration process are described below with reference to FIG. 3.

In an aspect, only one of the first magnetic field sensor 104 or the second magnetic field sensor 106 is used to make the "Open/Close" decision in order to conserve battery consumption. In an alternative aspect, however, respective pre-defined "Open" and "Closed" values may be determined for each one of the first magnetic field sensor 104 and the second magnetic field sensor 106, and both of the first magnetic field sensor 104 and the second magnetic field sensor 106 may be used to make the "Open/Close" decision.

In an aspect, the first magnetic field sensor 104 and the second magnetic field sensor 106 are positioned in a predetermined distance relative to one another, and having the sensing direction 126 substantially parallel to the magnetic field axis 124 of the permanent magnet 102. In an aspect, the first magnetic field sensor 104, the second magnetic field sensor 106, and the permanent magnet 102 are positioned such that when the door/window 122 is closed, the first magnetic field sensor 104 and the second magnetic field sensor 106 have their highest sensitivity to the magnetic field induced by the permanent magnet 102. Such relative positioning of the first magnetic field sensor 104, the second magnetic field sensor 106, and the permanent magnet 102 may be obtained during the installation of the contact sensor 100, and may result in easier detection of masking attempts.

For example, in one non-limiting example aspect as illustrated in FIG. 1, the first magnetic field sensor 104 and the second magnetic field sensor 106 are both positioned to have their highest sensitivity to magnetic fields in the direction of the Y axis. That is, the first magnetic field sensor 104 and the second magnetic field sensor 106 are both positioned such that the sensing direction 126 of the first magnetic field sensor 104 and the second magnetic field sensor 106 is substantially parallel to the Y axis. Further, the first magnetic field sensor 104 and the second magnetic field sensor 106 are positioned relative to the permanent magnet 102 such that when the door/window 122 is closed, the magnetic field induced by the permanent magnet 102 at the location of the first magnetic field sensor 104 and the second magnetic field sensor 106 is also substantially parallel to the Y axis. Thus, the sensing direction 126 of both the first magnetic field sensor 104 and the second magnetic field sensor 106 is substantially parallel to the magnetic field axis 124 of the permanent magnet 102 in the closed position. It should be understood that although both the first magnetic field sensor 104 and the second magnetic field sensor 106 are illustrated as being at a given Z axis height in FIG. 1, they may be located at any height, preferably at which their magnetic field measurements in the closed position of the permanent magnet 102 are at a maximum value.

In an aspect, the first magnetic field sensor 104 and the second magnetic field sensor 106 are positioned such that when the door/window 122 is closed, the sensing direction 126 of the first magnetic field sensor 104 and the second magnetic field sensor 106 is substantially parallel to a magnetic field axis 124 of the permanent magnet 102. However, the first magnetic field sensor 104 and the second magnetic field sensor 106 may be positioned such that when the door/window 122 is closed, the sensing direction 126 of the first magnetic field sensor 104 and the second magnetic field sensor 106 is either the same as or the opposite of the magnetic field direction along the magnetic field axis 124 of the permanent magnet 102. In either case, the direction of the magnetic field of the permanent magnet 102 may be accounted for during calibration.

In one non-limiting implementation, for example, the first magnetic field sensor 104 and the second magnetic field sensor 106 may have their highest sensitivity to the magnetic field of the permanent magnet 102 when the first magnetic field sensor 104 and the second magnetic field sensor 106 are positioned in a same plane that is perpendicular to the magnetic field axis 124 of the permanent magnet 102 in the closed position of the door/window 122, and when the same plane is aligned with a center of the permanent magnet 102, e.g., equidistant between a South pole and a North pole on the magnetic field axis 124 of the permanent magnet 102. Also, in some cases, in addition to being in the same plane, the first magnetic field sensor 104 and the second magnetic field sensor 106 are positioned along a same axis (such as at a same Z axis height) perpendicular to a plane containing the magnetic field axis 124 of the permanent magnet 102 in the closed position of the door/window 122. Thus, with this same plane and same height arrangement, the magnetic field values measured by the first magnetic field sensor 104 and the second magnetic field sensor 106 are maximal with the permanent magnet 102 in the closed position of the door/window 122 during calibration. As a result, when the door/window 122 is closed, the first magnetic field sensor 104 and the second magnetic field sensor 106 have their highest sensitivity to the magnetic field induced by the permanent magnet 102 when the door/window 122 is closed. Further, since the magnetic field values measured by the first magnetic field sensor 104 and the second magnetic field sensor 106 are maximal with the permanent magnet 102 in the closed position of the door/window 122, any increase in such measured values may be detected by the contact sensor 100 as a masking attempt.

It should be understood, however, that various fixed arrangements of the first magnetic field sensor 104 and the second magnetic field sensor 106 are possible depending on the sensor type used and/or the manufacturing of the sensor enclosures. For example, in one non-limiting implementation, the first magnetic field sensor 104 and the second magnetic field sensor 106 may be sensors that have their highest sensitivity to magnetic fields in the direction of the Y axis when the first magnetic field sensor 104 and the second magnetic field sensor 106 are installed "flat" on a device board 110 that is attachable to the second door/window component 120. In this case, the first magnetic field sensor 104 and the second magnetic field sensor 106 may be directly installed on the device board 110. However, in an alternative non-limiting implementation, the first magnetic field sensor 104 and the second magnetic field sensor 106 may be sensors that have their highest sensitivity to magnetic fields in the direction of the Y axis when the first magnetic field sensor 104 and the second magnetic field sensor 106 are mounted on a sensor board 108 that is perpendicularly attachable to the device board 110, where the device board 110 is attachable to the second door/window component 120. Further details of the aspects that implement the sensor board 108 are described below.

In an aspect, the device board 110 includes an electronic board such as a printed circuit board (PCB). In an aspect, the device board 110 houses a computing device 112, such as a microcontroller, that is configured to receive magnetic field measurements from the first magnetic field sensor 104 and the second magnetic field sensor 106 to make an "Open/Close" decision regarding the door/window 122 and/or a "Masking" decision regarding the contact sensor 100.

In aspects that include the sensor board 108, the device board 110 may substantially extend in an X-Y plane, and the sensor board 108 may substantially extend in an X-Z plane. In a non-limiting example aspect, the first magnetic field sensor 104 and the second magnetic field sensor 106 are substantially aligned along the X axis on the sensor board 108. When the door/window 122 is closed, the magnetic field axis 124 of the permanent magnet 102 substantially extends along the Y axis, regardless of the polarity or direction of the magnetic field axis 124, and the sensor board 108 is positioned substantially against the center of the permanent magnet 102 to allow for maximal measurement of the magnetic field of the permanent magnet 102 by the first magnetic field sensor 104 and the second magnetic field sensor 106.

In an aspect, the first magnetic field sensor 104 and the second magnetic field sensor 106 may be positioned, either on the device board 110 or on the sensor board 108 as applicable, with a known distance apart from each other, and the distance between the first magnetic field sensor 104 and the center of the permanent magnet 102 may be smaller than the distance between the second magnetic field sensor 106 and the center of the permanent magnet 102. Accordingly, the magnetic field of the permanent magnet 102 may be stronger at the location of the first magnetic field sensor 104 as compared to the location of the second magnetic field sensor 106. Further, as the door/window 122 opens, the magnetic field of the permanent magnet 102 may decrease at the location of the first magnetic field sensor 104 and at the location of the second magnetic field sensor 106.

In an aspect, the distance between the first magnetic field sensor 104 and the second magnetic field sensor 106, either on the sensor board 108 or on the device board 110 as applicable, may be set according to the performance/features/sensitivity of the sensor types selected for the first magnetic field sensor 104 and the second magnetic field sensor 106, which may be Hall effect sensors.

In an aspect, at least some calibration may be performed during manufacturing of the contact sensor 100. For example, as explained above, predefined open/close values or thresholds may be set during the manufacturing process.

In an aspect, the installation of the contact sensor 100 includes a calibration process.

For example, in an aspect, the masking thresholds may be set during a calibration phase during the installation of the contact sensor 100. For instance, when the door/window 122 is closed, the positioning of the first magnetic field sensor 104 and the second magnetic field sensor 106 is adjusted such that they each have a respective maximum magnetic field measurement.

The calibration process may be performed based on readouts of the first magnetic field sensor 104 and the second magnetic field sensor 106 and based on a known polarization of the magnetic field induced by the permanent magnet 102. In an aspect, the calibration process is conducted based on reading the readouts, and/or recording the readouts, of the first magnetic field sensor 104 and the second magnetic field sensor 106 when the door/window 122 is closed, e.g., the permanent magnet 102 is in the closed or calibration position. In cases where masking-related calibration is also performed during manufacturing, the installation on a door or window may be simulated through use of a calibration fixture, which can have similar mounting arrangements/configuration, and, optionally, similar movements, as a real door or window. As such, the contact sensor 100 may be mounted onto the calibration fixture for masking-related calibration. The calibration process may include measuring and recording a polarity of the permanent magnet 102 when the door/window 122 is closed. The calibration process may further include measuring and recording a magnetic field induced by the permanent magnet 102 at the location of the first magnetic field sensor 104 and the second magnetic field sensor 106 when the door/window 122 is closed. Further details of the calibration process are described below with reference to FIG. 3.

In aspects that include the sensor board 108, the contact sensor 100 may be installed according to an installation process including, for example, assembling the sensor board 108 and the device board 110 on the second door/window component 120 such that the sensor board 108 extends on the X-Z plane and is perpendicular to the device board 110 which extends on the X-Y plane, and that the first magnetic field sensor 104 and the second magnetic field sensor 106 are aligned along the X axis. The installation process may further include assembling the permanent magnet 102 on the first door/window component 118 such that the when the door/window 122 is closed, the magnetic field axis 124 of the permanent magnet 102 substantially extends along the Y axis, and the sensor board 108 is positioned substantially against the center of the permanent magnet 102.

In an aspect, the above installation steps may be verified based on readouts of the permanent magnet 102 and the second magnetic field sensor 106. In an aspect, if the magnetic field values measured by the permanent magnet 102 and the second magnetic field sensor 106 during installation are not within a pre-defined window for each of sensor, the installation is determined to have failed.

In an aspect, the readouts of the first magnetic field sensor 104 and/or the second magnetic field sensor 106 may be compared against respective recorded values that have been determined during the calibration process, in order to make a "Masking" decision indicating whether an additional permanent magnet is applied to tamper with the contact sensor 100. For example, in an aspect, a first tampering permanent magnet 114 or a second tampering permanent magnet 116 may be placed in the vicinity of the contact sensor 100 to tamper with the "Open/Close" decision determined by the contact sensor 100. For example, the first tampering permanent magnet 114 may be placed close to the permanent magnet 102 and/or the second tampering permanent magnet 116 may be placed close to the device board 110 to affect the readouts of the first magnetic field sensor 104 and the second magnetic field sensor 106.

In an aspect, if the first tampering permanent magnet 114 is placed with an opposite magnetic polarization compared to the permanent magnet 102, the effective magnetic field induced at the location of the first magnetic field sensor 104 and the second magnetic field sensor 106 is reduced, and the "Open/Close" function of the contact sensor 100 may indicate that the door/window 122 has been opened. However, in some optional aspects, if the contact sensor 100 has already received an indication that the door/window 122 is locked, for example, based on another sensor indicating a "Door Locked" status, the contact sensor 100 may compare the aforementioned reduced readouts of the first magnetic field sensor 104 and the second magnetic field sensor 106 with respective calibrated thresholds to make a "Masking" decision indicating the tampering.

Similarly, if the second tampering permanent magnet 116 is placed with an opposite magnetic polarization compared to the permanent magnet 102, the effective magnetic field induced at the location of the first magnetic field sensor 104 and the second magnetic field sensor 106 is reduced, and the "Open/Close" function of the contact sensor 100 may again indicate that the door/window 122 has been opened. However, the reduction in the effective magnetic field induced at the location of the first magnetic field sensor 104 and the second magnetic field sensor 106 due to the second tampering permanent magnet 116 may be substantially different than the reduction in the effective magnetic field induced at the location of the first magnetic field sensor 104 and the second magnetic field sensor 106 due to the door/window 122 opening. For example, if the second tampering permanent magnet 116 is placed with an opposite magnetic polarization compared to the permanent magnet 102, the reduction in the readout of the second magnetic field sensor 106 may be greater than the reduction in the readout of the first magnetic field sensor 104. Accordingly, even without having another sensor indicating a "Door Locked" status, the contact sensor 100 may compare the aforementioned reduced readouts of the first magnetic field sensor 104 and the second magnetic field sensor 106 with respective calibrated thresholds to make a "Masking" decision indicating the tampering. Alternatively and/or additionally, in some optional aspects, the contact sensor 100 may also receive an indication that the door/window 122 is locked, for example, based on another sensor indicating a "Door Locked" status, and then compare the aforementioned reduced readouts of the first magnetic field sensor 104 and the second magnetic field sensor 106 with respective calibrated thresholds to make a "Masking" decision indicating the tampering.

Further, if the first tampering permanent magnet 114 is placed with an opposite magnetic polarization compared to the permanent magnet 102, and the first tampering permanent magnet 114 is strong enough to reverse the magnetic polarization of the effective magnetic field induced at the location of the first magnetic field sensor 104 and the second magnetic field sensor 106, the contact sensor 100 may detect such change in the magnetic polarization in the readouts of the first magnetic field sensor 104 and the second magnetic field sensor 106 and make a "Masking" decision indicating the tampering.

Similarly, if the second tampering permanent magnet 116 is placed with an opposite magnetic polarization compared to the permanent magnet 102, and the second tampering permanent magnet 116 is strong enough to reverse the magnetic polarization of the effective magnetic field induced at the location of the first magnetic field sensor 104 and the second magnetic field sensor 106, the contact sensor 100 may detect such change in the magnetic polarization in the readouts of the first magnetic field sensor 104 and the second magnetic field sensor 106 and make a "Masking" decision indicating the tampering.

In an aspect, if the first tampering permanent magnet 114 is placed with the same magnetic polarization as the permanent magnet 102, the effective magnetic field induced at the location of the first magnetic field sensor 104 and the second magnetic field sensor 106 increases, and the contact sensor 100 may compare the readouts of the first magnetic field sensor 104 and the second magnetic field sensor 106 with respective calibrated thresholds to make a "Masking" decision indicating the tampering.

Similarly, if the second tampering permanent magnet 116 is placed with the same magnetic polarization as the permanent magnet 102, the effective magnetic field induced at the location of the first magnetic field sensor 104 and the second magnetic field sensor 106 increases, and the contact sensor 100 may compare the readouts of the first magnetic field sensor 104 and the second magnetic field sensor 106 with respective calibrated thresholds to make a "Masking" decision indicating the tampering.

In an aspect, the contact sensor 100 may periodically make and/or update the "Masking" decision during the time when the door/window 122 is closed, e.g., to detect a change in value corresponding to one of the "Masking" conditions described above.

In an aspect, the contact sensor 100 may apply a threshold value to the readouts of the first magnetic field sensor 104 and/or the second magnetic field sensor 106 when making the "Open/Close" decision and/or the "Masking" decision. In an aspect, the threshold values used for making the "Open/Close" decisions may be pre-determined fixed values obtained/decided during development of the contact sensor 100, and may be related to sensor features, such as sensitivity, of the first magnetic field sensor 104 and/or the second magnetic field sensor 106. Further, the threshold values used for making the "Masking" decision may be obtained/decided during the calibration process.

In an optional aspect, for example but not limited to this example, a tolerance may be applied to a readout of the first magnetic field sensor 104 and/or the second magnetic field sensor 106 and may be less than 10% of the magnetic field value measured by the first magnetic field sensor 104 and/or the second magnetic field sensor 106.

Figure 2:
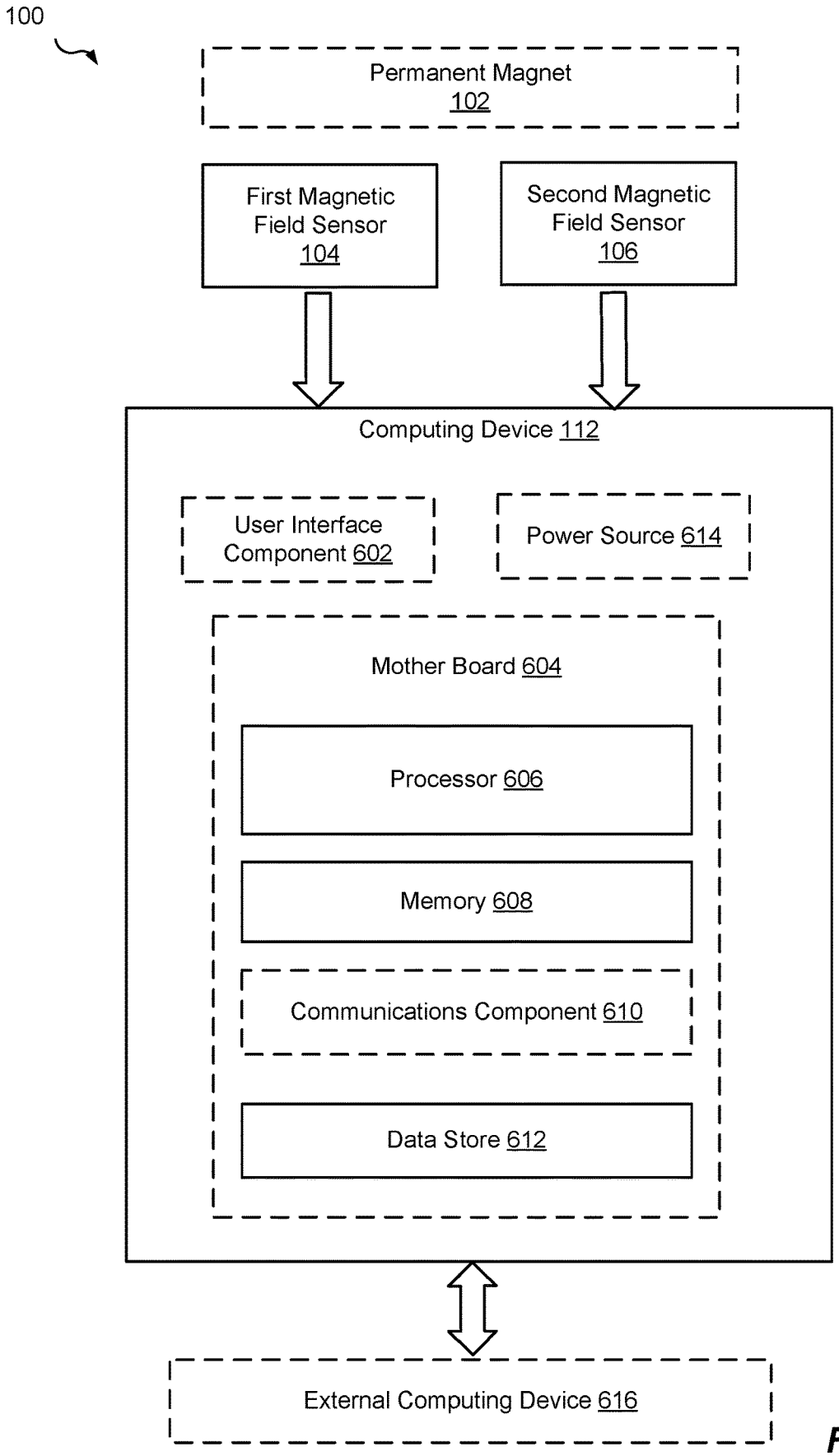
FIG. 2 is a block diagram of the example contact sensor of FIG. 1.

FIG. 2 illustrates an example block diagram providing further details of the computing device 112 of the contact sensor 100. In an example, the computing device 112 may include a mother board 604, and the mother board 604 may include a processor 606 configured to make an "Open/Close" decision and/or a "Masking" decision based on readouts of the first magnetic field sensor 104 and/or the second magnetic field sensor 106 that are subject to a magnetic field induced by the permanent magnet 102. In an aspect, the computing device 112 may communicate with an external computing device 616 regarding the operation of the contact sensor 100 and/or any decisions/detections made by contact sensor 100 and/or the readouts of the first magnetic field sensor 104 and/or the second magnetic field sensor 106, as will be discussed below in more detail.

The processor 606 may be a micro-controller and/or may include a single or multiple set of processors or multi-core processors. Moreover, the processor 606 may be implemented as an integrated processing system and/or a distributed processing system. The mother board 604 may further include memory 608, such as for storing local versions of applications being executed by the processor 606, related instructions, parameters, etc. The memory 608 may include a type of memory usable by a computer, such as random access memory (RAM), read only memory (ROM), tapes, magnetic discs, optical discs, volatile memory, non-volatile memory, and any combination thereof. Additionally, the processor 606 and the memory 608 may include and execute an operating system executing on the processor 606, one or more applications, display drivers, etc., and/or other components of the computing device 112.

Further, the mother board 604 may include a communications component 610 that provides for establishing and maintaining communications with one or more other devices, parties, entities, etc. utilizing hardware, software, and services. The communications component 610 may carry communications between components on the computing device 112, as well as between the computing device 112 and external devices, such as devices located across a communications network and/or devices serially or locally connected to the computing device 112. For example, the communications component 610 may include one or more buses, and may further include transmit chain components and receive chain components associated with a wireless or wired transmitter and receiver, respectively, operable for interfacing with external devices.

Additionally, the mother board 604 may include a data store 612, which can be any suitable combination of hardware and/or software, that provides for mass storage of information, databases, and programs. For example, a data store 612 may be or may include a data repository for applications and/or related parameters not currently being executed by processor 606. In addition, the data store 612 may be a data repository for an operating system, application, display driver, etc., executing on the processor 606, and/or one or more other components of the computing device 112.

The computing device 112 may also include a user interface component 602 operable to receive inputs from a user of the computing device 112 and further operable to generate outputs for presentation to the user (e.g., via a display interface to a display device). The user interface component 602 may include one or more input devices, including but not limited to a keyboard, a number pad, a mouse, a touch-sensitive display, a navigation key, a function key, a microphone, a voice recognition component, or any other mechanism capable of receiving an input from a user, or any combination thereof. Further, the user interface component 602 may include one or more output devices, including but not limited to a display interface, a speaker, a haptic feedback mechanism, a printer, any other mechanism capable of presenting an output to a user, or any combination thereof.

In an aspect, the computing device 112 further includes a power source 614 that provides AC or DC power (e.g., battery power operated device) to power up the computing device 112. Alternatively, the computing device 112 may be powered up by a power source that is external to the computing device 112.

In an aspect, the computing device 112 may use the communications component 610 to communicate, either wirelessly or through a wired connection, with an external computing device 616 regarding the operation of the contact sensor 100 and/or any decisions/detections made by contact sensor 100 and/or the readouts of the first magnetic field sensor 104 and/or the second magnetic field sensor 106. For example, the computing device 112 may communicate an "Open/Close" decision and/or a "Masking" decision to the external computing device 616. The external computing device 616 may be, for example, a central security control system, and may include any components described above with reference to the computing device 112.

Alternatively, the external computing device 616 may be, for example, a user device such as a cellular phone or a wearable device configured to alert a user of an "Open/Close" decision and/or a "Masking" decision.

In an aspect, the computing device 112 and/or the external computing device 616 may be configured to allow for taking a mitigating security action in response to an "Open/Close" decision and/or a "Masking" decision made by the contact sensor 100, such as activating a visual or audio alarm, turning on one or more lights in the vicinity of the door/window 122, enabling a central lock system, etc.

Figure 3:
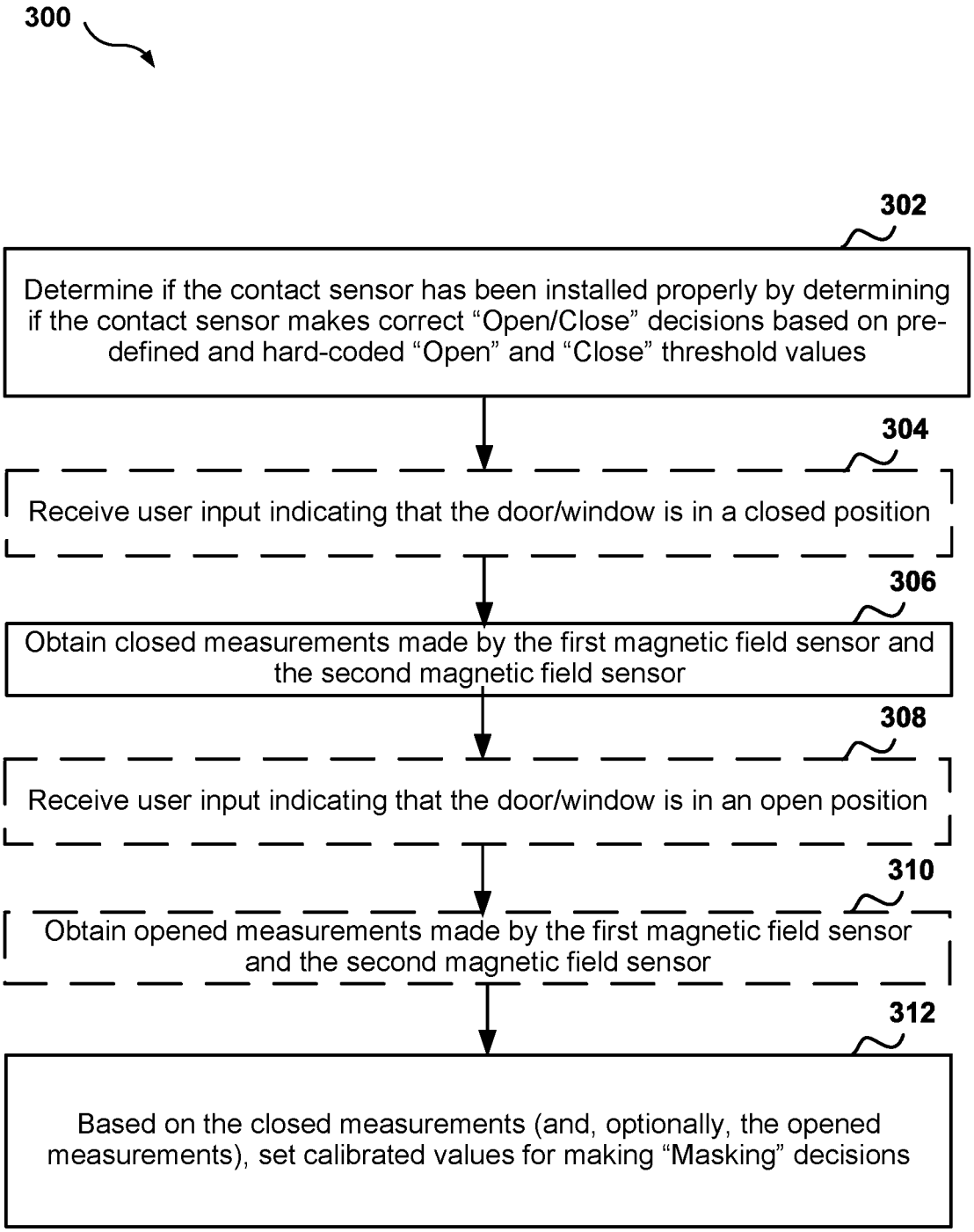
FIG. 3 is a flowchart of a method of installation/calibration of the example contact sensor of FIG. 1.

FIG. 3 is a flowchart of a method 300 of installation and calibration of the contact sensor 100. The method 300 may be performed by an apparatus such as the computing device 112 as described herein with reference to FIG. 2.

At 302 the method 300 may include determining if the contact sensor has been installed properly by determining if the contact sensor makes correct "Open/Close" decisions based on pre-defined and hard-coded "Open" and "Close" threshold values. For example, a user/person may install the permanent magnet 102 on the first door/window component 118 of the door/window 122, and install the device board 110, including the first magnetic field sensor 104, the second magnetic field sensor 106, and the computing device 112, on the second door/window component 120 of the door/window 122. The person/user may then observe the "Open/Close" decisions and indication output by the contact sensor 100, where such decisions/indications are made by the contact sensor 100 by comparing the magnetic field measurements of the first magnetic field sensor 104 and the second magnetic field sensor 106 with respective pre-defined and hard-coded "Open" and "Close" threshold values. As such, the pre-defined and fixed threshold values may be used to decide if the installation is correct or if the installation needs re-adjusting. If the contact sensor 100 makes incorrect "Open/Close" decisions, the person/user may determine that the installation is not OK and may repeat 302.

In an aspect, the person/user may adjust the installation of at least one of the permanent magnet 102, the device board 110, the sensor board 108, the first magnetic field sensor 104, or the second magnetic field sensor 106 in the "Closed" position of the door/window 122 until the magnetic field measured by the first magnetic field sensor 104 and the second magnetic field sensor 106 is at its maximum.

After proper device installation at 302, the values that will be associated with "Masking" decisions may be calibrated. In an aspect, for example, further measurements may be made to obtain calibrated "Masking" measurements for making the "Masking" decision, as follows.

At 304, the method 300 may optionally include receiving user input indicating that the door/window is in a closed position. For example, the user may close the door/window 122 and provide a corresponding indication. For example, in an aspect, there may be provided a measure (e.g., a switch) to set the device into learning (calibrating) mode.

At 306, the method 300 may include obtaining closed calibrated measurements by the first magnetic field sensor and the second magnetic field sensor. For example, the device may read the measurements of the first magnetic field sensor 104 and the second magnetic field sensor 106 in the closed position of the door/window 122.

At 308, the method 300 may optionally include receiving user input indicating that the door/window is in an opened position. For example, the user may open the door/window 122 and provide a corresponding indication.

At 310, the method 300 may optionally include obtaining opened measurements by the first magnetic field sensor and the second magnetic field sensor. For example, the device may read the measurements of the first magnetic field sensor 104 and the second magnetic field sensor 106 in the opened position of the door/window 122.

At 312, the method 300 may include, based on the closed measurements (and, optionally, the opened measurements), setting calibrated values for making "Masking" decisions. Such calibrated values may include, for example, calibrated sensor measurements, corresponding thresholds, and/or calibrated polarity measurements.

Figure 4:
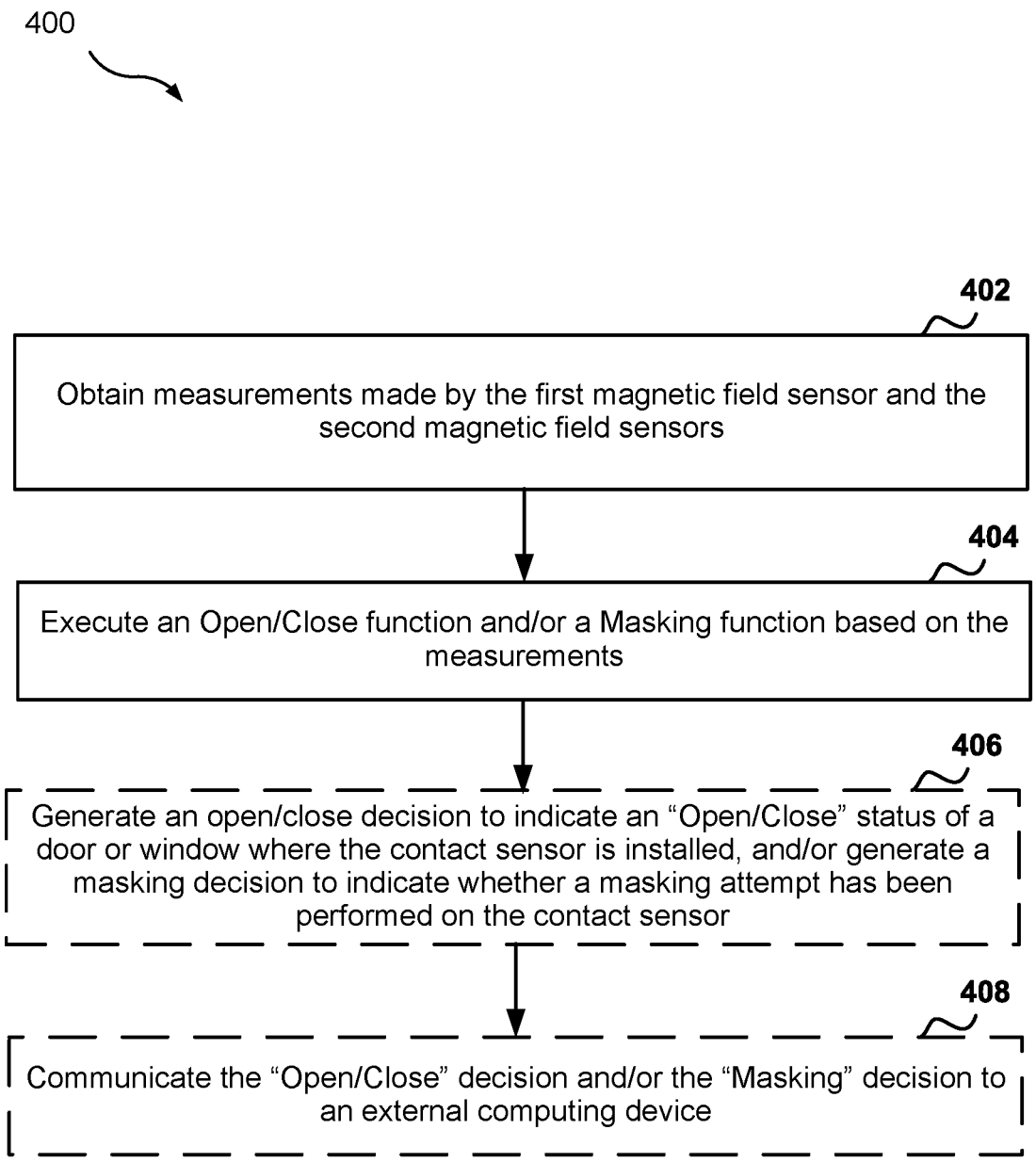
FIG. 4 is a flowchart of a method of operation of the example contact sensor of FIG. 1 to provide an "Open/Close" and/or a "Masking" indication.

FIG. 4 is a flowchart of a method 400 of operation of the contact sensor 100 to provide an "Open/Close" and/or a "Masking" indication. The method 400 may be performed by an apparatus such as the computing device 112 as described herein with reference to FIG. 2.

At 402, the method 400 may include obtaining measurements by the first magnetic field sensor and the second magnetic field sensor. For example, after installing and calibrating the contact sensor 100 on a door/window 122 and closing the door/window 122, the computing device 112 may periodically obtain measurements of the first magnetic field sensor 104 and the second magnetic field sensor 106.

At 404, the method 400 may include executing an "Open/Close" function and/or a "Masking" function based on the measurements. For example, the computing device 112 may execute an "Open/Close" function and/or a "Masking" function based on at least one of the measurements, for example, as described herein with reference to FIG. 1 or as recited in the appended claims.

Optionally, at 406, the method 400 may further include, in response to executing an "Open/Close" function and a "Masking" function based on the measurements, generating an open/close decision to indicate an "Open/Close" status of a door or window where the contact sensor is installed, and/or generating a masking decision to indicate whether a masking attempt has been performed on the contact sensor.

Optionally, at 408, the method 400 may further include communicating the "Open/Close" decision and/or the "Masking" decision to an external computing device. For example, in further optional implementations, computing device 112 may communicate the "Open/Close" decision and/or the "Masking" decision to the external computing device 616 (FIG. 2), which in response may generate/output a notification (e.g., present a notice on a display of the external computing device 616) and/or an alert (e.g., generate an audible alarm on a speaker of the external computing device 616), depending on the value of each decision. For instance, if a masking attempt is indicated by the "Masking" decision, then the external computing device 616 may trigger an alarm and/or may perform other security functions (e.g., lock programmable locks, etc.) with one or more other security devices associated with the system.

In some implementations, the apparatus of the present disclosure may be in the form of a kit of parts that can be assembled to form the apparatus. For instance, in an aspect contact sensor kit is provided. The contact sensor kit may include the permanent magnet 102, the first magnetic field sensor 104, the second magnetic field sensor 106, the sensor board 108, the device board 110, and the computing device 112.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. A contact sensor, comprising:

a first magnetic field sensor configured to make a first measurement of a magnetic field induced by a permanent magnet that is movable between at least a first magnet position and a second magnet position and that has a magnet body extending along a magnetic field axis;

a second magnetic field sensor configured to make a second measurement of the magnetic field, wherein a sensing direction of the first magnetic field sensor and the second magnetic field sensor is substantially in parallel to the magnetic field axis of the permanent magnet when the permanent magnet is at one of the first magnet position or the second magnet position; and a computing device in communication with the first magnetic field sensor and the second magnetic field sensor and configured to execute an "Open/Close" function and a "Masking" function based on at least one of the first measurement or the second measurement.

2. The contact sensor of claim 1, wherein the "Open/Close" function is configured to indicate an "Open/Close" status of a door or window where the contact sensor is installed, wherein the "Masking" function is configured to indicate whether a masking attempt has been performed on the contact sensor.

3. The contact sensor of claim 2, wherein the "Open/Close" function determines an "Open/Close" decision by at least one of:

determining, in response to the first measurement being larger than a first calibrated "Closed" measurement of the first magnetic field sensor corresponding to a first "Closed" calibration position of the first magnetic field sensor within the magnetic field, that the door or window is closed; or determining, in response to the second measurement being larger than a second calibrated "Closed" measurement of the second magnetic field sensor corresponding to a second "Closed" calibration position of the second magnetic field sensor within the magnetic field, that the door or window is closed; or determining, in response to the first measurement being smaller than a first calibrated "Open" measurement of the first magnetic field sensor corresponding to a first "Open" calibration position of the first magnetic field sensor within the magnetic field, that the door or window is open; or determining, in response to the second measurement being smaller than a second calibrated "Open" measurement of the second magnetic field sensor corresponding to a second "Open" calibration position of the second magnetic field sensor within the magnetic field, that the door or window is open.

4. The contact sensor of claim 1, wherein the "Masking" function determines a "Masking" decision by at least one of:

determining whether the first measurement is larger than a first calibrated "Masking" measurement of the first magnetic field sensor at a first "Closed" calibration position within the magnetic field; or determining whether the second measurement is larger than a second calibrated "Masking" measurement of the second magnetic field sensor at a second "Closed" calibration position within the magnetic field.

5. The contact sensor of claim 4, wherein the first calibrated "Masking" measurement of the first magnetic field sensor is a first maximum measurement obtainable by the first magnetic field sensor during calibration of the contact sensor, wherein the second calibrated "Masking" measurement of the second magnetic field sensor is a second maximum measurement obtainable by the second magnetic field sensor during calibration of the contact sensor.

6. The contact sensor of claim 1, wherein a first calibrated "Closed" measurement of the first magnetic field sensor at a first "Closed" calibration position within the magnetic field is larger than a second calibrated "Closed" measurement of the second magnetic field sensor at a second "Closed" calibration position within the magnetic field, wherein the "Masking" function determines a "Masking" decision by determining whether the first measurement is smaller than the second measurement.

7. The contact sensor of claim 1, wherein the "Masking" function determines a "Masking" decision by at least one of:

determining whether a first magnetic polarity associated with the first measurement is different than a first calibrated magnetic polarity measurement of the first magnetic field sensor at a first "Closed" calibration position within the magnetic field; or determining whether a second magnetic polarity associated with the second measurement is different than a second calibrated magnetic polarity measurement of the second magnetic field sensor at a second "Closed" calibration position within the magnetic field.

8. The contact sensor of claim 1, wherein the first magnetic field sensor and the second magnetic field sensor are Hall effect sensors.

9. The contact sensor of claim 1, further comprising the permanent magnet.

10. The contact sensor of claim 9, wherein the second magnetic field sensor is configured at a pre-determined distance relative to the first magnetic field sensor.

11. The contact sensor of claim 9, wherein the sensing direction of the first magnetic field sensor and the second magnetic field sensor is substantially parallel to the magnetic field axis of the magnetic field of the permanent magnet in a calibrating position where the "Open/Close" function indicates a "Closed" status.

12. The contact sensor of claim 9, wherein the first magnetic field sensor and the second magnetic field sensor are positioned in a plane that is substantially perpendicular to the magnetic field axis of the permanent magnet in a calibrating position where the "Open/Close" function indicates a "Closed" status.

13. The contact sensor of claim 9, wherein the first magnetic field sensor and the second magnetic field sensor are positioned in a plane that is equidistant to a North pole and a South pole of the permanent magnet in a calibrating position where the "Open/Close" function indicates a "Closed" status.

14. The contact sensor of claim 9, wherein the permanent magnet is movably positionable between at least a first position and a second position relative to both the first magnetic field sensor and the second magnetic field sensor, wherein the first position is closer than the second position to both the first magnetic field sensor and the second magnetic field sensor, and wherein the first position corresponds to a calibrating position where the "Open/Close" function indicates a "Closed" status.

15. The contact sensor of claim 1, wherein the first magnetic field sensor and the second magnetic field sensor are both positioned along an axis that is perpendicular to the magnetic field axis of the permanent magnet when the permanent magnet is at one of the first magnet position or the second magnet position.

16. A contact sensor, comprising:

a first magnetic field sensor configured to make a first measurement of a magnetic field;

a second magnetic field sensor configured to make a second measurement of the magnetic field; and a computing device in communication with the first magnetic field sensor and the second magnetic field sensor and configured to execute an "Open/Close" function and a "Masking" function based on at least one of the first measurement or the second measurement, wherein a first calibrated "Closed" measurement of the first magnetic field sensor at a first "Closed" calibration position within the magnetic field is larger than a second calibrated "Closed" measurement of the second magnetic field sensor at a second "Closed" calibration position within the magnetic field, wherein the "Masking" function determines a "Masking" decision by determining whether the first measurement is smaller than the second measurement.

17. The contact sensor of claim 16, wherein the "Open/Close" function is configured to indicate an "Open/Close" status of a door or window where the contact sensor is installed, wherein the "Masking" function is configured to indicate whether a masking attempt has been performed on the contact sensor.

18. A contact sensor, comprising:

a first magnetic field sensor configured to make a first measurement of a magnetic field;

a second magnetic field sensor configured to make a second measurement of the magnetic field; and a computing device in communication with the first magnetic field sensor and the second magnetic field sensor and configured to execute an "Open/Close" function and a "Masking" function based on at least one of the first measurement or the second measurement, wherein the "Masking" function determines a "Masking" decision by at least one of:

determining whether a first magnetic polarity associated with the first measurement is different than a first calibrated magnetic polarity measurement of the first magnetic field sensor at a first "Closed" calibration position within the magnetic field; or determining whether a second magnetic polarity associated with the second measurement is different than a second calibrated magnetic polarity measurement of the second magnetic field sensor at a second "Closed" calibration position within the magnetic field.

19. The contact sensor of claim 18, wherein the "Open/Close" function is configured to indicate an "Open/Close" status of a door or window where the contact sensor is installed, wherein the "Masking" function is configured to indicate whether a masking attempt has been performed on the contact sensor.

* * * * *